US007270496B2

(12) United States Patent
Morgan et al.

(10) Patent No.: US 7,270,496 B2
(45) Date of Patent: Sep. 18, 2007

(54) RING MECHANISM FOR A RING BINDER

(75) Inventors: Marilyn J. Morgan, Downers Grove, IL (US); Paul D. Hatch, Chicago, IL (US); Chris K. Barmore, Chicago, IL (US); Philip M. Anthony, III, Chicago, IL (US); Aaron B. Eiger, Chicago, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 657 days.

(21) Appl. No.: 10/854,404

(22) Filed: May 26, 2004

(65) Prior Publication Data

US 2005/0265775 A1 Dec. 1, 2005

(51) Int. Cl.
*B42F 3/04* (2006.01)

(52) U.S. Cl. ..... 402/38; 402/31; 402/36

(58) Field of Classification Search ..... 402/38, 402/41, 31, 26

See application file for complete search history.

(56) References Cited

U.S. PATENT DOCUMENTS

| | | | | | |
|---|---|---|---|---|---|
| 1,927,113 | A * | 9/1933 | Dawson | 402/38 |
| 3,098,490 | A | 7/1963 | Wance | |
| 4,522,526 | A * | 6/1985 | Lozfau et al. | 402/37 |
| 4,813,803 | A | 3/1989 | Gross | |
| 5,067,840 | A | 11/1991 | Cooper et al. | |
| 5,116,157 | A | 5/1992 | Gillum et al. | |
| 5,255,991 | A | 10/1993 | Sparkes | |
| 5,354,142 | A * | 10/1994 | Yu | 402/41 |
| 5,836,709 | A * | 11/1998 | Cheung | 402/38 |
| 5,904,435 | A * | 5/1999 | Tung | 402/38 |
| 6,172,360 | B1 * | 1/2001 | Khovaylo et al. | 250/235 |
| 6,206,601 | B1 * | 3/2001 | Ko | 402/38 |
| 6,280,114 | B1 * | 8/2001 | To | 402/38 |
| 6,364,558 | B1 * | 4/2002 | To | 402/38 |
| 6,467,984 | B1 * | 10/2002 | To | 402/38 |
| 6,474,897 | B1 * | 11/2002 | To | 402/38 |
| 6,533,486 | B1 * | 3/2003 | To | 402/38 |
| 6,536,980 | B2 * | 3/2003 | To | 402/26 |

(Continued)

OTHER PUBLICATIONS

Stephen P. Corr, et al, U.S. Appl. No. 10/355,414, filed Jan. 31, 2003.

Ring mechanism that was publicly available at least as early as Apr. 2003 (see attached Statement of Relevance and Figures 1-5), not received.

*Primary Examiner*—Willmon Fridie, Jr.
(74) *Attorney, Agent, or Firm*—Michael Best & Friedrich LLP

(57) ABSTRACT

A ring mechanism includes a chassis and a hinge blade coupled to the chassis. An actuator coupled to the chassis moves the hinge blade between a first position and a second position. A ring half coupled to the hinge blade is positioned in a closed position when the hinge blade is in the first position, and an open position when the hinge blade is in the second position. A dampening member is positioned at least partially between the inner surface of the chassis and the actuator to prevent at least a portion of the actuator from directly engaging the inner surface of the chassis during movement of the actuator between the first and second positions. A locked state indicator indicates to the user whether the ring mechanism is in a locked position or an unlocked position. The dampening member can function as the lock state indicator and vice versa.

27 Claims, 6 Drawing Sheets

U.S. PATENT DOCUMENTS 6,591,526 B1 * 7/2003 Garrett ..... 40/455
6,840,695 B2 * 1/2005 Horn ..... 402/31
2001/0026726 A1 10/2001 To
2005/0260030 A1 * 11/2005 Wong ..... 402/54

* cited by examiner

RING MECHANISM FOR A RING BINDER

FIELD OF THE INVENTION

The invention relates to ring binders, and more particularly to ring mechanisms for ring binders.

BACKGROUND OF THE INVENTION

Ring binders often employ a ring mechanism that is movable between an open position, which allows a user to insert documents into the ring binder, and a closed position, which allows the user to securely store the documents in the ring binder. Some ring mechanisms include a locking member that prevents inadvertent opening of the ring mechanism when the ring binder is subjected to forces such as bumping or dropping. The locking member can be moved between a locked position and an unlocked position. Ring mechanisms that include a locking member can only be opened for insertion of documents when the locking member is in the unlocked position.

Ring mechanisms often include an elongated chassis and an actuator that is movable relative to the chassis to move the ring mechanism between the open and closed positions. Ring mechanisms that include a locking member may also utilize the actuator to move the locking member between the locked and unlocked positions. The chassis and the actuator are conventionally formed of stamped metal. Movement of the actuator relative to the chassis can cause metal-to-metal contact between the actuator and the inner surface of the chassis, which can result in undesirable noise or a non-smooth feel.

SUMMARY OF THE INVENTION

The present invention provides a dampening member that substantially reduces the metal-to-metal contact that can be made when an actuator is moved relative to the inner surface of a chassis. More specifically, the dampening member is positioned at least partially between the inner surface of the chassis and the actuator to prevent at least a portion of the actuator from directly engaging the inner surface of the chassis. In one embodiment of the invention, the dampening member includes a non-metallic member made of a plastic material, an elastomeric material, or any other suitable material. The non-metallic member is preferably connected to the actuator.

The above-described ring mechanism can be used to practice a method of operating a ring mechanism. The method includes positioning the dampening member at least partially between the inner surface of the chassis and the actuator and positioning the ring mechanism in the closed position. The method also includes operating the ring mechanism to the open position from the closed position by moving the actuator relative to the chassis so the dampening member substantially prevents at least a portion of the actuator from directly engaging the inner surface of the chassis.

The present invention also provides a locked state indicator for use in a ring mechanism that includes a locking member. The locked state indicator indicates to the user whether the ring mechanism is in the locked position or the unlocked position. More specifically, the invention provides a ring mechanism that includes a chassis having an aperture and a viewable member that is more visible through the aperture in one of the locked and unlocked positions than in the other of the locked and unlocked positions. In one embodiment, the viewable member is coupled to the actuator. The viewable member is preferably a color different than the color of the chassis adjacent to the aperture. In another embodiment, the chassis includes a second aperture, and the viewable member is more visible through the second aperture in the other of the locked and unlocked positions than in the one of the locked and unlocked positions. Preferably, the viewable member comprises the above-described dampening member.

The above-described ring mechanism can be used to practice a method of indicating a locked state of a ring mechanism. The method includes positioning the viewable member for movement relative to the viewing aperture. The method also includes moving the ring mechanism between a locked position and an unlocked position such that the viewable member is more visible through the viewing aperture in one of the locked and unlocked positions than in the other of the locked and unlocked positions.

Further objects of the present invention together with the organization and manner of operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" are used broadly and encompass both direct and indirect mountings, connections, supports, and couplings. Further, "connected" and "coupled" are not restricted to physical or mechanical connections or couplings.

DETAILED DESCRIPTION

Figure 1:
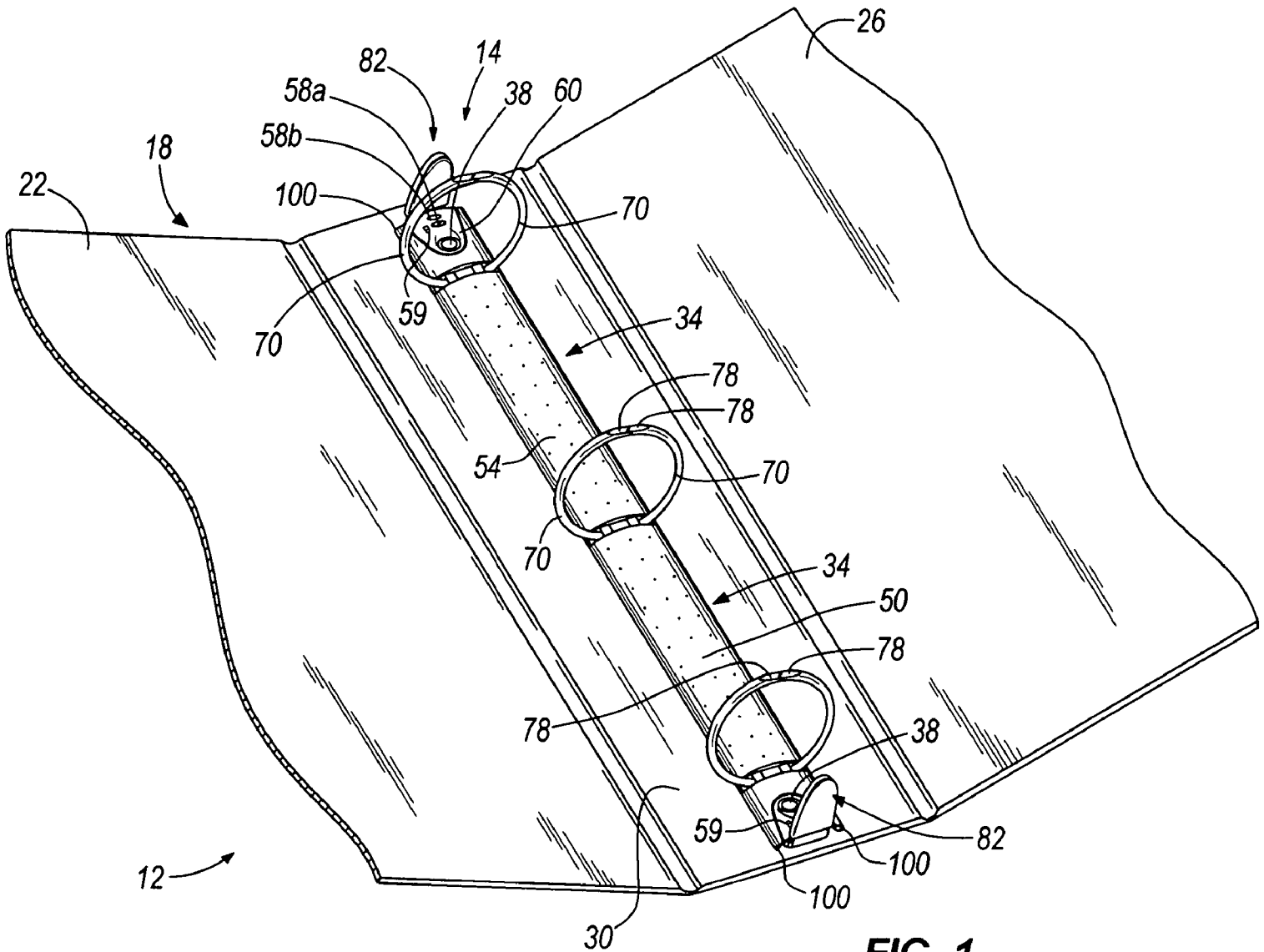
FIG. 1 is a partial perspective view of a ring binder including a ring mechanism embodying the present invention.

FIG. 1 illustrates a ring binder 12 incorporating a ring mechanism 14 embodying the present invention. The ring binder 12 includes a flat 18 having a front panel 22, a rear panel 26, and a spine 30 that hingedly connects the front and rear panels 22 and 26. It should be understood, however, that the front and rear panels 22 and 26 may be coupled together directly without the use of the spine 30. The illustrated front panel 22, rear panel 26, and spine 30 are formed of a vinyl covered cardboard material, but could be plastic or any other suitable material.

The ring mechanism 14 includes a chassis 34 that is coupled to a mounting surface of the flat 18 by at least one post 38 or other suitable fastener, such as a rivet. In the illustrated embodiment, the mounting surface is the spine 30.

Figure 9:
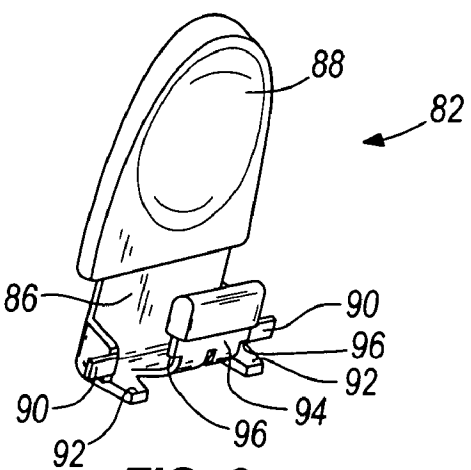
FIG. 9 is a perspective view of an actuator of the ring mechanism shown in FIG. 1.
Figure 11:
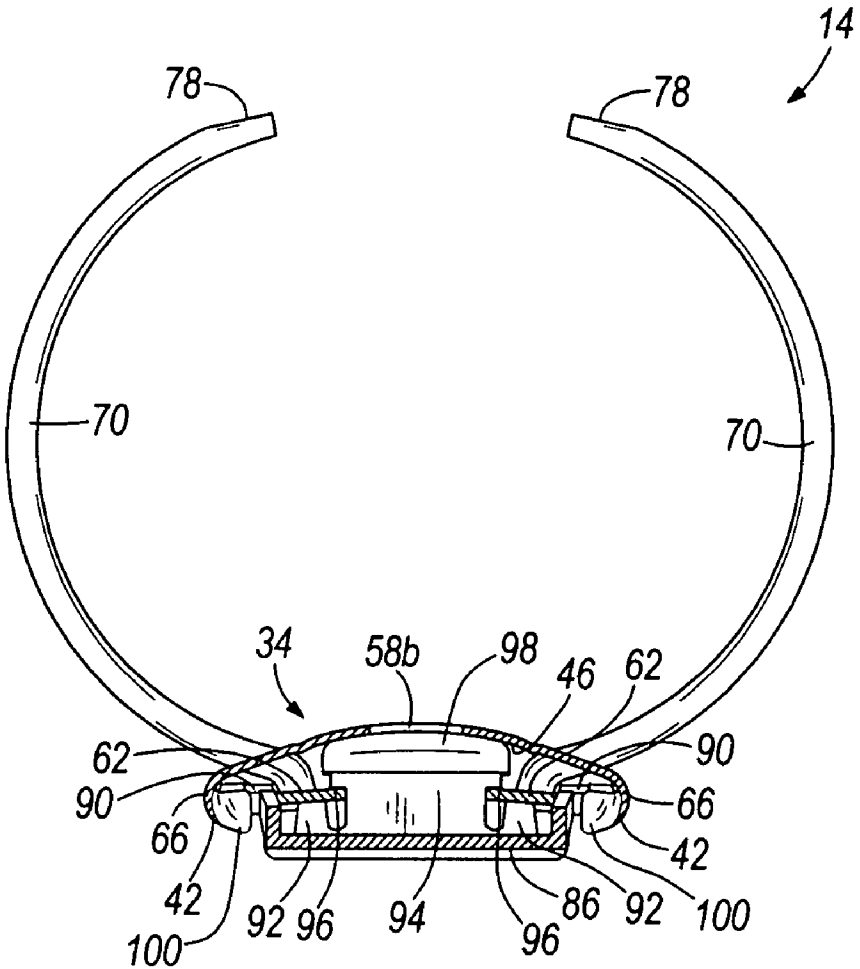
FIG. 11 is a section view of the ring mechanism of FIG. 8 taken along line 11-11.
Figure 10:
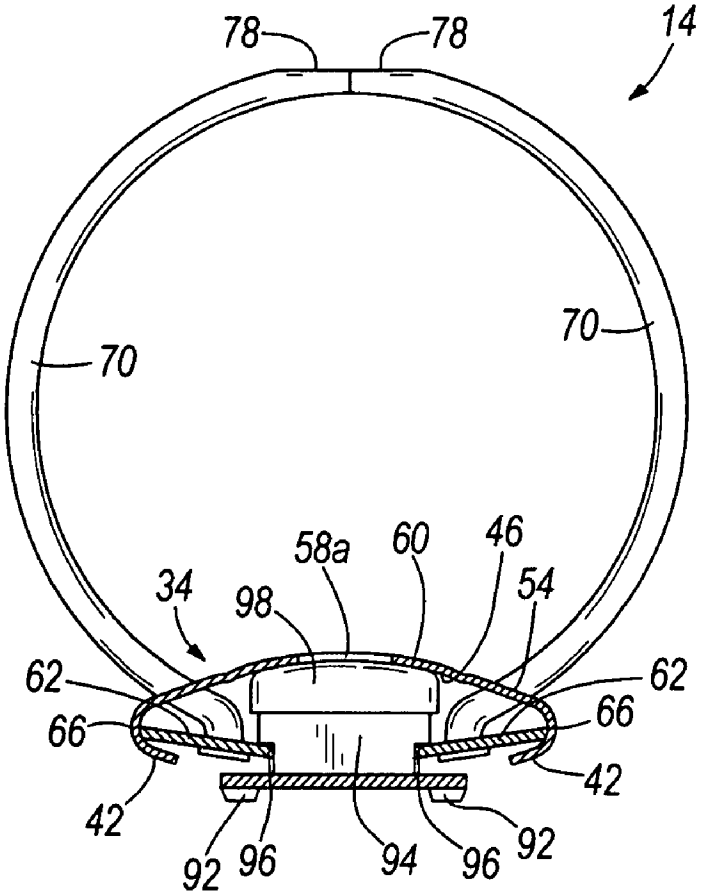
FIG. 10 is a section view of the ring mechanism of FIG. 6 taken along line 10-10.
Figure 13:
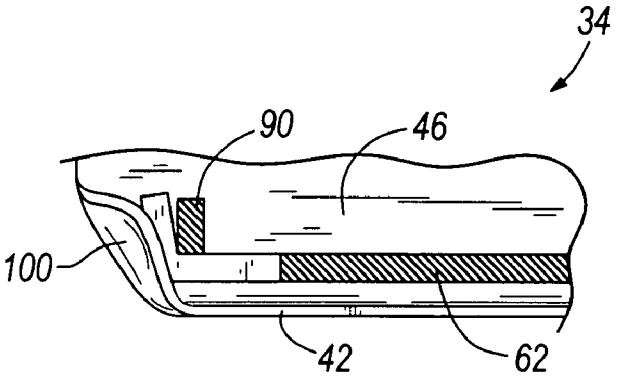
FIG. 13 is a section view of the ring mechanism of FIG. 12 taken along line 13-13.

FIGS. 2-13 illustrate the ring mechanism 14 in more detail. As best shown in FIGS. 10 and 11, the chassis 34 has crimped edges 42 and an inner surface 46 extending between the crimped edges 42. With reference to FIGS. 1-5, the illustrated chassis 34 includes a grid of dots or markings 50 on the outer surface 54. In one construction, the markings 50 may be formed as protuberances extending outwardly from the chassis 34. In another construction, the markings 50 may be formed as indentations in the chassis 34. In yet other constructions, the markings 50 may be alternatively formed in, or applied to the chassis 34 (e.g., using a screen printing process, securing an additional layer of material, and the like).

Figure 2:
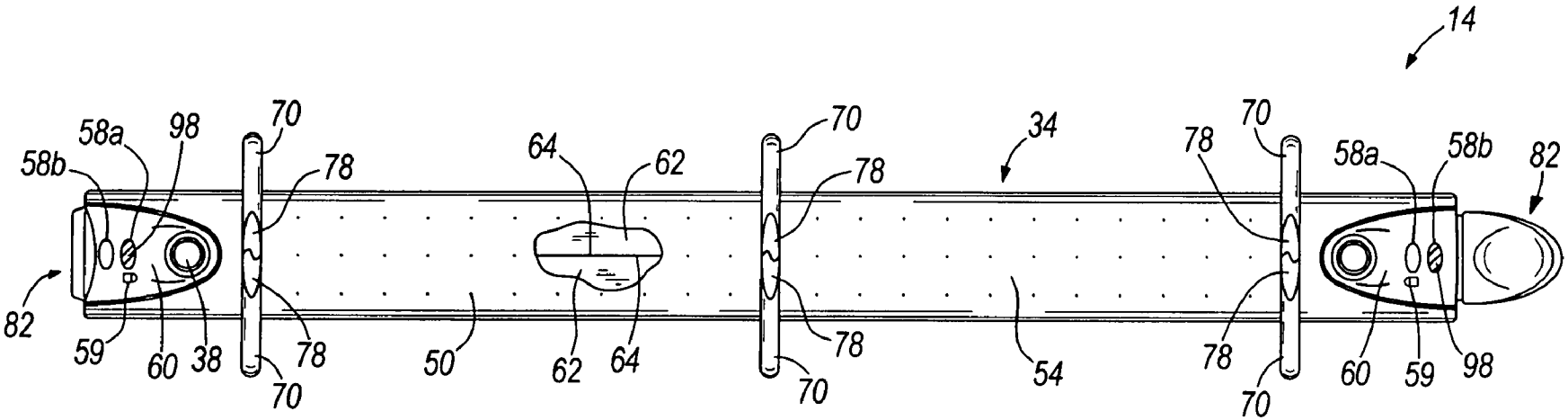
FIG. 2 is a partially cutaway top view of the ring mechanism of FIG. 1 showing the ring mechanism in a closed-locked position with one of the actuators in an unlocked position.
Figure 3:
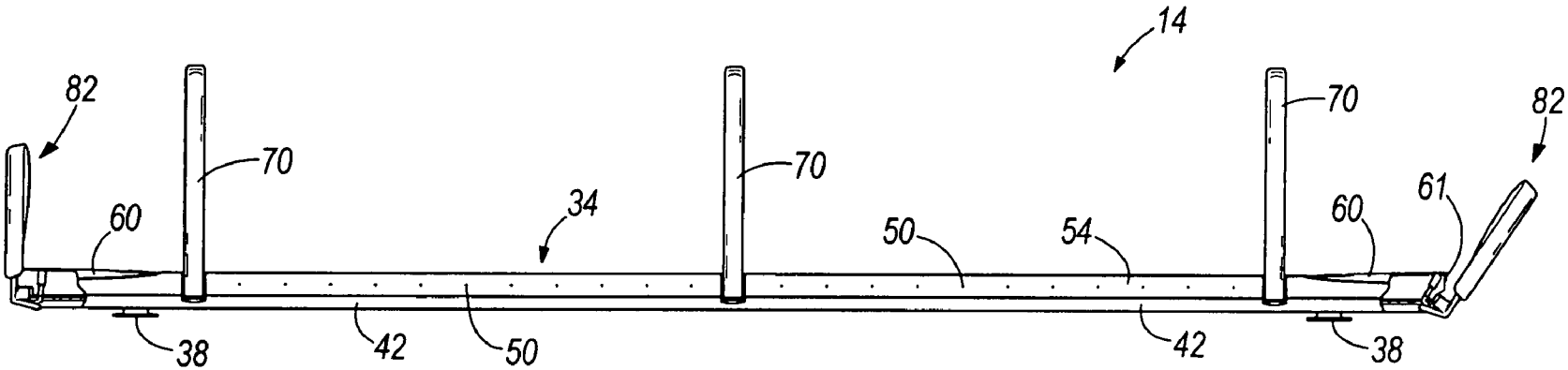
FIG. 3 is a partial cutaway elevation view of the ring mechanism of FIG. 2 showing the ring mechanism in the closed-locked position with one of the actuators in an unlocked position.
Figure 4:
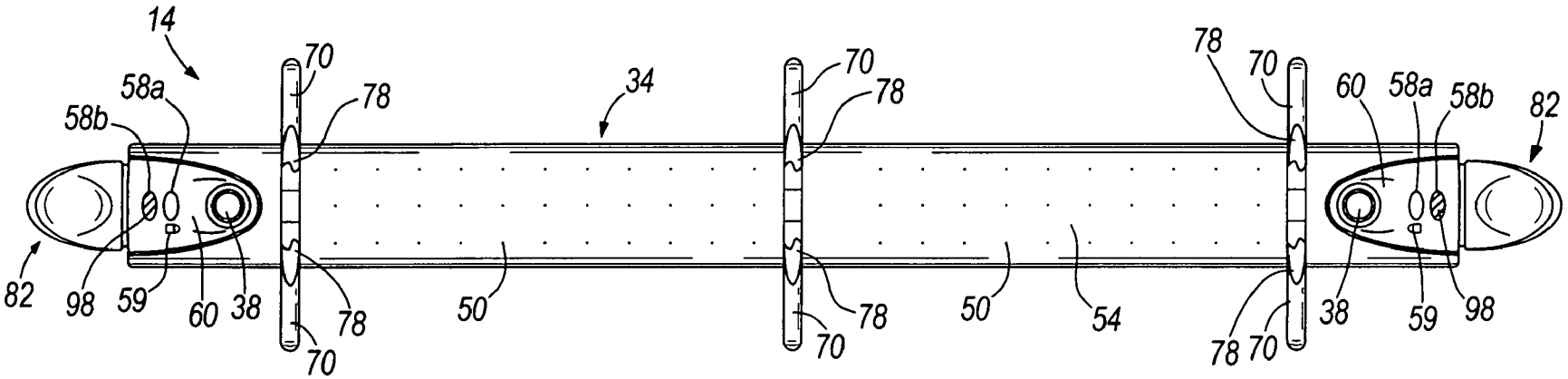
FIG. 4 is a top view of the ring mechanism of FIG. 1 showing the ring mechanism in the open position.

With reference to FIGS. 2 and 4, the chassis 34 includes a set of two windows 58 positioned at each end of the chassis 34. The illustrated windows 58 are oval in shape, but may be alternatively sized and/or shaped (e.g., circular, rectangular, triangular, and the like) in other embodiments. The illustrated chassis 34 further includes a window indicia 59 adjacent to one of the two windows 58 at each end of the chassis 34. The illustrated window indicia 59 is a closed lock symbol, but may be alternatively configured in other embodiments (e.g., an opened lock symbol, the word LOCKED, the word UNLOCKED, and the like).

Figure 7:
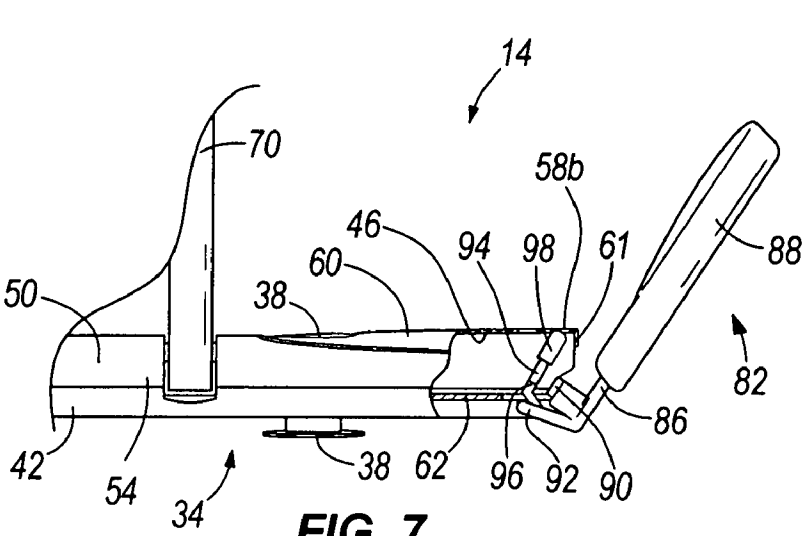
FIG. 7 is an enlarged view of a portion of the right side of FIG. 3 showing the ring mechanism in the closed-unlocked position.
Figure 8:
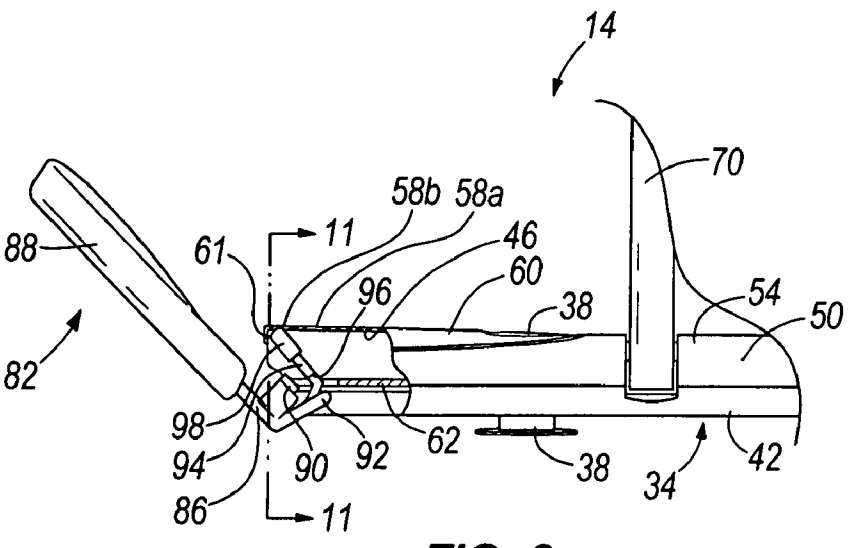
FIG. 8 is an enlarged view of a portion of the left side of FIG. 5 showing the ring mechanism in the open position.

The chassis 34 further includes a raised portion 60 positioned at each end of the chassis 34. The windows 58 and the post 38 are each positioned in a respective raised portion 60. With reference to FIGS. 7 and 8, a downwardly extending wall portion 61 extends from the outward end of each raised portion 60.

With reference to FIGS. 2 and 10-12, the ring mechanism 14 further includes two hinge blades 62 supported by the chassis 34. Each hinge blade 62 has an inner edge 64 (shown in the partially cutaway portion of FIG. 2 and in FIG. 12) and an outer edge 66. The hinge blades 62 are positioned relative to the chassis 34 such that the crimped edges 42 of the chassis 34 retain the respective outer edges 66 of the hinge blades 62. As the ring mechanism 14 is moved between a closed position (see FIGS. 1-3, 6, 7, 10, and 12-13) and an open position (see FIGS. 4, 5, 8, and 11), the hinge blades 62 pivot about their respective outer edges 66. The inner edges 64 move toward or away from the inner surface 46 of the chassis 34 to pivot from a lower position (see FIG. 10) to an upper position (see FIG. 11).

Figure 14:
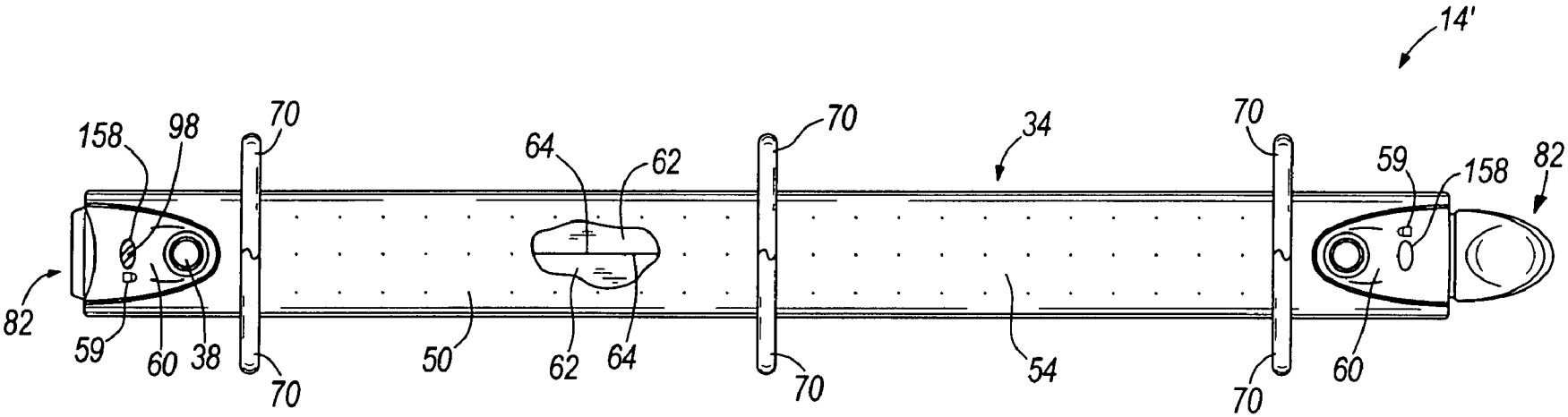
FIG. 14 is a partially cutaway top view of another ring mechanism embodying the present invention showing the ring mechanism in a closed-locked position with one of the actuators in an unlocked position.

The ring mechanism 14 further includes multiple ring halves 70 coupled to each hinge blade 62. Together, each set of ring halves 70 defines a ring that can be opened or closed upon movement of the hinge blades 62 (see FIGS. 10 and 11). Each ring is designed to engage a corresponding hole in the sheets of material retained by the ring binder 12. In embodiments where only one hinge blade is present in the ring mechanism 14, at least one ring half is coupled to the hinge blade and a corresponding ring half is coupled to the chassis such that the corresponding ring halves still define a ring. The illustrated hinge blades 62 each include three ring halves 70, but it should be understood that any number of ring halves 70 may be coupled to the hinge blades 62. The illustrated ring halves 70 have a generally rounded cross-sectional profile with a flat portion 78 near the top end. The flat portion 78 can serve as a visual indicator to let the user know that the ring mechanism 14 has reached full capacity, and thus cannot practically accommodate additional sheets of material. In other embodiments, the ring halves 70 may be alternatively sized and/or shaped (e.g., D-shaped). Further, in some embodiments, the flat portions 78 can be eliminated (see FIG. 14).

The illustrated ring mechanism 14 further includes two actuators 82 coupled to the chassis 34 and engageable with the hinge blades 62. In the illustrated embodiment, the actuators 82 include two pivotable levers that are pivotably supported on the ends of the chassis 34. As best illustrated in FIG. 9, each actuator 82 includes a generally L-shaped body portion 86, a grip portion 88 extending upwardly from the body portion 86, and a pivot projection 90 extending from each side of the body portion 86. Each actuator 82 also includes a pair of hinge-opening projections 92 extending forwardly from the body portion 86, and a locking portion 94 extending forwardly and upwardly from the body portion 86. The underside of the locking portion 94 includes a pair of hinge-closing projections 96, and a cover 98 is positioned on a top side of the locking portion 94.

Figure 12:
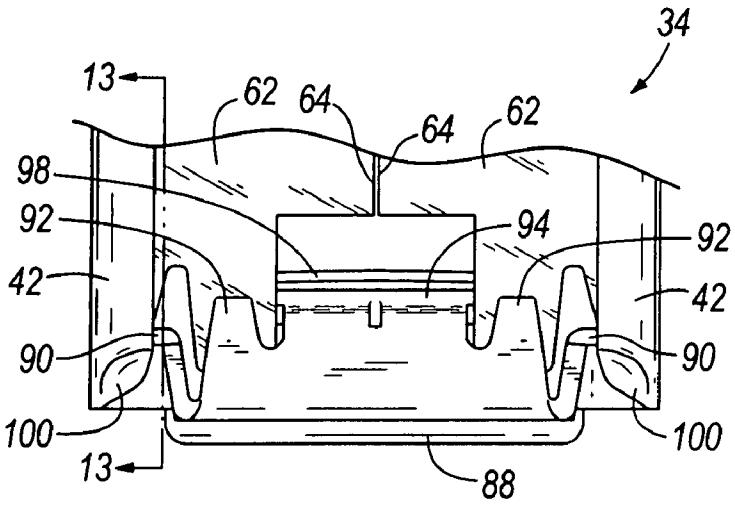
FIG. 12 is a partial bottom view of a portion of the of the ring mechanism of FIG. 1 showing the ring mechanism in a closed-locked position.

For assembly, the actuator 82 is placed adjacent to the chassis 34 and the hinge blades 62. With reference to FIG. 12, the hinge blades 62 include recesses sized to receive at least a portion of the locking portion 94 and at least a portion of the pivot projections 90 for movement of the locking portion 94 and the pivot projections 90 relative to the hinge blades 62. With reference to FIGS. 1 and 10-13, end portions 100 of the chassis 34 are bent or crimped to retain the actuator 82 and the hinge blades 62 in the chassis 34. When assembled, each pivot projection 90 engages an upper surface of a respective crimped end portion of the hinge blades 62 (see FIG. 13) during pivotable movement of the actuator 82 relative to the chassis 34.

When an actuator 82 is coupled to the chassis 34, the grip portion 88 extends away from the chassis 34. The illustrated grip portion 88 includes a scoop shape (as best shown in FIGS. 1 and 9) that is contoured for engagement by the fingers of a user to pivot the actuator 82 relative to the chassis 34. The grip portion 88 includes a cushion member that covers the metal construction of the actuator 82. The cushion member is a soft pad of resilient material such as an elastomeric material or a soft plastic material. The cushion member provides improved tactile characteristics to the grip portion 88, making movement of the actuator 82 more comfortable for the user. The cushion member also minimizes the feedback of undesirable shock forces produced by the snap action of the ring halves 70 and the hinge blades 62 when opening and closing the ring mechanism 14.

Figure 5:
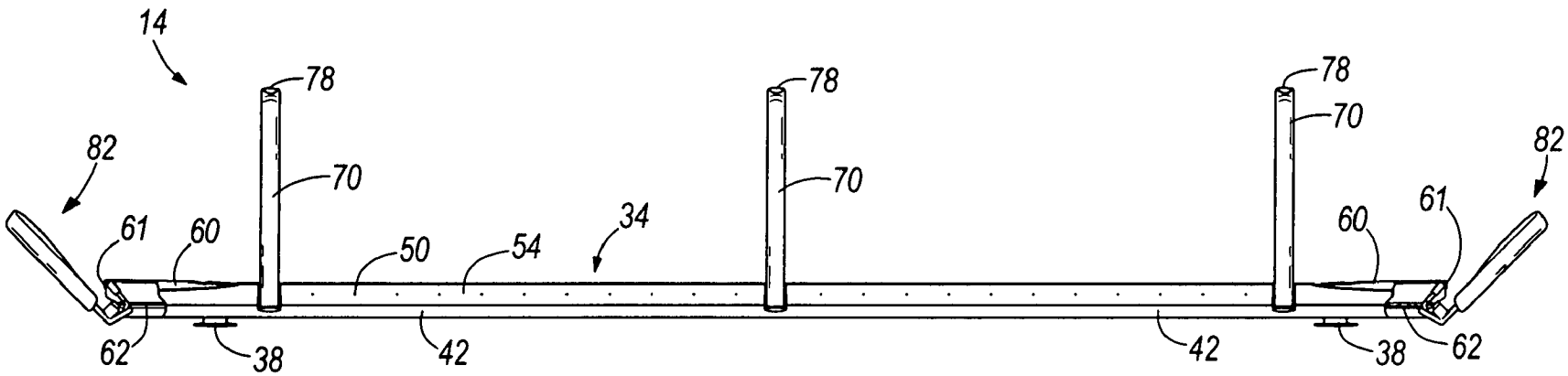
FIG. 5 is a partially cutaway elevation view of the ring mechanism of FIG. 4 showing the ring mechanism in the open position.

The ring mechanism 14 is opened and closed by moving the actuators 82 between a locked position (see FIGS. 1 and 6), an unlocked position (see FIG. 7), and an open position (see FIGS. 4, 5, and 8). The ring mechanism 14 is only movable to the open position when both actuators 82 are in the unlocked position. The ring mechanism 14 is in the closed-locked position when at least one actuator 82 is in the locked position (e.g., see FIGS. 2 and 3), and is in the closed-unlocked position when both actuators 82 are in the unlocked position. The ring mechanism 14 may also be moved from the closed-unlocked position to the open position by grasping and pulling apart the sets of ring halves 70.

Figure 6:
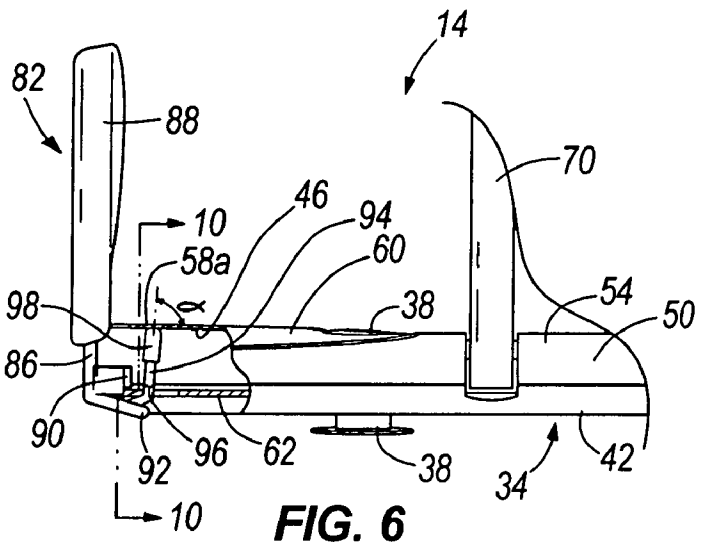
FIG. 6 is an enlarged view of a portion of the left side of FIG. 3 showing the ring mechanism in the closed-locked position.

With reference to FIG. 6, when the ring mechanism 14 is in the closed-locked position, the hinge-opening projections 92 are spaced from the lower surface of the hinge blades 62, and the hinge-closing projections 96 engage the upper surface of the hinge blades 62. Also, the pivot projections 90 are engaged with the upper surface of the respective hinge blade adjacent the crimped end portion of the hinge blade 62 (see FIG. 13), and the body portion 86 is engaged with the downwardly extending wall portion 61 (shown in FIG. 8), thus preventing further inward and downward movement of the hinge-closing projections 96.

When in a locked position, a locking member in the form of the locking portions 94 prevents inadvertent opening of the ring mechanism 14 (e.g., opening due to bumping or dropping the ring mechanism 14) and prevents opening of the ring mechanism 14 using means other than the actuators 82 (e.g., applying a lateral force to a set of corresponding ring halves 70). When the locking member is in the locked position, a top surface of each locking portion 94 engages the inner surface 46 of the chassis 34 and the hinge-closing projections 96 engage the upper surface of the hinge blades 62. The top surface of each locking portion 94 may have a profile that generally matches the sectional profile of the inner surface 46 of the chassis 34. In some constructions, each locking portion 94 is slightly over-center and inwardly directed towards the post 38 in order to give inherent resistance to unintended movement of the respective actuator 82 to the unlocked position and/or the open position. This over-center relationship is illustrated in FIG. 6 by the acute angle $\alpha$ formed between the locking portion 94 and the raised portion 60 of the chassis 34. Regardless of the force applied to the ring halves 70 when the locking member is in the locked position, the hinge blades 62 are prevented from moving from the lower position. Even if a large force is exerted on the ring halves 70, the actuators 82 will remain in the locked position because such forces will tend to force the locking portions 94 to move inwardly, thus further wedging the top surface of the locking portion 94 against the inner surface 46 of the inwardly decreasing height of the raised portion 60.

As the actuators 82 are moved outwardly from the locked position to the unlocked position, the pivot projections 90 act as a two-point fulcrum to cause the top surface of the locking portion 94 to move outwardly generally along the inner surface 46 of the chassis 34. Thus, the locking portions 94 move to an unlocked position.

With reference to FIG. 7, when the ring mechanism 14 is in the closed-unlocked position, the hinge-opening projections 92 engage the lower surface of the hinge blades 62 and the hinge-closing projections 96 are spaced from the upper surface of the hinge blades 62. Additional movement of the actuators 82 in an outward direction causes the hinge-opening projections 92 to push up the lower surface of the hinge blades 62 to move the hinge blades 62 from the lower position to the upper position.

Although the substantially vertically upstanding locking portion 94 of the locked position prevents forces applied to the ring halves 70 from opening the ring mechanism 14, the angled locking portion 94 of the unlocked position allows such forces to move the hinge blades 62 from the lower position to the upper position. Thus, the ring mechanism 14 opens. When the ring mechanism 14 is opened in any manner beside moving the actuators 82 outwardly, the engagement between the actuators 82 and the hinge blades 62 causes the actuators 82 to move to the open position.

With reference to FIG. 8, when the ring mechanism 14 is in the open position, the hinge-opening projections 92 engage the lower surface of the hinge blades 62, the hinge-closing projections 96 engage the upper surface of the hinge blades 62, and the locking portion 94 engages the wall portion 61, thereby preventing further outward movement of the actuators 82. Movement of the actuators 82 in an inward direction causes the hinge-closing projections 96 to push down the upper surface of the hinge blades 62 and the hinge-opening projections 92 to disengage the lower surface of the hinge blades 62 so the hinge blades 62 pivot about the outer edges 66 and move from the upper position to the lower position.

A dampening member in the form of the cover 98 is positioned within the ring mechanism 14 to decrease the metal-to-metal contact made when moving the actuator 82 relative to the chassis 34. Reduction of the metal-to-metal contact provides a more fluid movement of the actuator 82 relative to the chassis 34. Further, similar to the cushion member of the grip portion 88, the dampening member also minimizes the feedback of undesirable shock forces produced by the snap action of the ring halves 70 and the hinge blades 62 when opening and closing the ring mechanism 14. Although the dampening member is described with respect to reducing metal-to-metal contact, the dampening member may also provide advantages in reducing contact between actuators and/or chassis made of other materials.

The cover 98 is positioned between the inner surface 46 of the chassis 34 and the generally metal construction of the actuator 82. The cover 98 acts as a buffer between the metal frame of the locking portion 94 and the inner surface 46 of the chassis 34 to prevent direct engagement between the two. In the illustrated embodiment, the cover 98 is positioned on the end of the locking portion 94 of the actuator 82. In other embodiments, the cover 98 may be positioned on another portion of the actuator 82 and prevent direct engagement between that portion of the actuator 82 and the inner surface 46 of the chassis 34. The dampening member may be positioned on the inner surface 46 of the chassis 34, on a portion of the actuator 82, and/or alternatively positioned between the inner surface 46 of the chassis 34 and the actuator 82.

The dampening member can be formed of a plastic material, an elastomeric material, or any other suitable material. In some embodiments, the dampening member is compressed between the actuator 82 and the chassis 34 as the ring mechanism 14 is operated. The dampening member may be formed as a separate component and connected to the actuator 82 and/or the chassis 34. In other embodiments, the dampening member may be a coating applied to the actuator 82 and/or the chassis 34. In yet other embodiments, the dampening member may be an integrally formed portion of the actuator 82 and/or the chassis 34.

A locked state indicator is provided on the ring mechanism 14 to indicate the locked state of the locking member. The locked state indicator includes a viewing member in the form of the windows 58 and a viewable member in the form of the cover 98. The locked state indicator indicates to the user whether the locking member is locked or unlocked. Indication of the locked state of the locking member assists the user in preventing inadvertent opening of the ring mechanism 14. Further, indication of the locked state of the locking member assists the user when opening the ring mechanism 14 using the rings 70.

With reference to FIG. 2, the illustrated windows 58 are positioned such that the cover 98 is visible through a first window 58*a* when the respective locking portion 94 is in the locked position, and the cover 98 is visible through a second window 58*b* when the respective locking portion 94 is in the unlocked position or the open position.

In other embodiments, the chassis 34 may include a single window positioned at each end of the chassis 34 through which the cover 98 is more visible in one of the locked and the unlocked positions than the other of the locked and unlocked positions. For example, see FIG. 14, which illustrates an alternative ring mechanism 14' including a single window 158 positioned at each end of the chassis 34 through which the cover 98 is more visible in the locked position than the unlocked position. Except for this difference in window configuration, the absence of the flat portion 78 on the rings 70 discussed above, and a relocation of one of the window indicia 59, the mechanism 14' is substantially similar to the ring mechanism 14 of FIG. 2 and like parts have been given like reference numerals.

In other embodiments, the chassis 34 may include an alternative arrangement of windows positioned on the chassis 34 (e.g., one total, one pair, one pair positioned at a single end of the chassis 34, three positioned at each end of the chassis 34, and the like) through which the cover 98 is more visible in one of the locked and the unlocked positions than the other of the locked and unlocked positions. In yet other embodiments, the chassis 34 may include a segmented window having portions equivalent to separate windows. For example, the cover 98 may be more visible through a first portion of the segmented window in the locked position, and more visible through a second portion of the segmented window in the unlocked position.

The window indicia 59 is positioned adjacent to the first window 58*a* to graphically indicate the locking portion 94 is in the locked position. In other embodiments, the window indicia 59 may be positioned adjacent to the second window 58*a*, or the window indicia 59 may be positioned adjacent to each of the windows 58*a* and 58*b*. In yet other embodiments, an indicia similar to the window indicia 59 may be positioned on the viewable member.

Generally, the viewable member includes a color different than the color of the chassis 34 adjacent the window 58 such that the viewable member is readily visible through the respective window 58. The illustrated cover 98 is red and the chassis 34 is nickel colored.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

The invention claimed is:

1. A ring mechanism comprising:

a chassis having an inner surface;

a hinge blade coupled to the chassis, the hinge blade being movable between a first position and a second position;

a ring half coupled to the hinge blade, the ring half being movable between a closed position when the hinge blade is in the first position, and an open position when the hinge blade is in the second position;

an actuator coupled to the chassis and configured to move the hinge blade between the first position and the second position; and a dampening member positioned at least partially between the inner surface of the chassis and the actuator so that at least a portion of the actuator is substantially prevented from directly engaging the inner surface of the chassis.

2. The ring mechanism of claim 1, wherein the dampening member is non-metallic.

3. The ring mechanism of claim 2, wherein the dampening member is formed of at least one of a plastic material and an elastomeric material.

4. The ring mechanism of claim 1, wherein the dampening member is fixedly connected to the actuator.

5. The ring mechanism of claim 1, wherein the actuator includes an end portion, and wherein the end portion includes the dampening member.

6. The ring mechanism of claim 5, wherein the dampening member includes a non-metallic cover at least partially covering the end portion.

7. The ring mechanism of claim 1, wherein the chassis includes an aperture, and wherein the dampening member is more visible through the aperture when the hinge blade is in one of the first and second positions than when the hinge blade is in the other of the first and second positions to indicate a locked state of the ring mechanism.

8. The ring mechanism of claim 1, wherein the actuator includes a lever that is pivotable relative to the chassis.

9. The ring mechanism of claim 1, wherein the inner surface includes a metallic portion, wherein the actuator includes a metallic end portion, and wherein the dampening member is engaged with both the metallic end portion and the metallic portion of the inner surface.

10. A method of operating a ring mechanism configured for use with a binder, the ring mechanism including a chassis with an inner surface, and an actuator that is movable relative to the chassis to move the ring mechanism between an open position and a closed position, the method comprising:

positioning a dampening member at least partially between the inner surface of the chassis and the actuator;

positioning the ring mechanism in the closed position; and operating the ring mechanism to the open position from the closed position by moving the actuator relative to the chassis so the dampening member substantially prevents at least a portion of the actuator from directly engaging the inner surface of the chassis.

11. The method of claim 10, wherein positioning a dampening member at least partially between the inner surface of the chassis and the actuator includes positioning a non-metallic dampening member at least partially between a metallic portion of the inner surface of the chassis and a metallic end portion of the actuator.

12. The method of claim 10, wherein positioning a dampening member includes fixedly connecting the dampening member to the at least a portion of the actuator.

13. The method of claim 10, wherein operating the ring mechanism includes compressing the dampening member between the actuator and the chassis.

14. A ring mechanism comprising:

a chassis having an aperture;

a hinge blade coupled to the chassis;

an actuator movable between a first position where the hinge blade is locked relative to the chassis and a second position where the hinge blade is unlocked relative to the chassis; and a viewable member that is more visible through the aperture in one of the first and second positions than in the other of the first and second positions to indicate a locked state of the ring mechanism.

15. The ring mechanism of claim 14, wherein the viewable member is coupled to the actuator.

16. The ring mechanism of claim 14, wherein the viewable member covers at least a portion of the actuator.

17. The ring mechanism of claim 14, wherein the viewable member is a color different than the color of the chassis adjacent the aperture.

18. The ring mechanism of claim 14, wherein the chassis includes a second aperture, and wherein the viewable member is more visible through the second aperture in the other of the first and second positions than in the one of the first and second positions.

19. The ring mechanism of claim 14, wherein the viewable member is generally aligned with the aperture in the one of the first and second positions, and wherein the viewable member is generally not aligned with the aperture in the other of the first and second positions.

20. The ring mechanism of claim 14, wherein the chassis includes an indicia adjacent the aperture.

21. The ring mechanism of claim 20, wherein the indicia includes a closed lock symbol.

22. The ring mechanism of claim 14, wherein the viewable member is non-metallic and prevents metal-to-metal contact between a metallic portion of the actuator and a metallic inner surface of the chassis.

23. A method of indicating a locked state of a ring mechanism movable between a locked position and an unlocked position, the ring mechanism including a viewing aperture and a viewable member, the method comprising:

positioning the viewable member for movement relative to the viewing aperture; and moving the ring mechanism between the locked position and the unlocked position such that the viewable member is more visible through the viewing aperture in one of the locked and unlocked positions than in the other of the locked and unlocked positions.

24. The method of claim 23, wherein the ring mechanism includes a chassis and an actuator that is movable relative to the chassis to move the ring mechanism between the locked position and the unlocked position, and further comprising fixedly connecting the viewable member to the actuator.

25. The method of claim 24, wherein moving the ring mechanism between the locked position and the unlocked position includes pivotably moving the actuator relative to the chassis.

26. The method of claim 23, wherein the ring mechanism includes a chassis having a metallic inner surface and an actuator having a metallic end portion, the actuator being movable relative to the chassis to move the ring mechanism between the locked position and the unlocked position, wherein the viewable member is non-metallic, and further comprising positioning the viewable member between the metallic end portion of the actuator and the metallic inner surface of the chassis to prevent metal-to-metal contact between the metallic end portion of the actuator and the metallic inner surface of the chassis.

27. The method of claim 23 wherein the ring mechanism includes a second viewing aperture, and wherein moving the ring mechanism between the locked position and the unlocked position includes moving the ring mechanism such that the viewable member is more visible through the second viewing aperture in the other of the locked and unlocked positions than in the one of the locked and unlocked positions.

* * * * *